US006575608B2

(12) United States Patent
Oyama et al.

(10) Patent No.: US 6,575,608 B2
(45) Date of Patent: Jun. 10, 2003

(54) VEHICLE LAMP

(75) Inventors: Hiroo Oyama, Sagamihara (JP); Go Adachi, Tokyo (JP); Takashi Akutagawa, Kawasaki (JP); Yoshifumi Kawaguchi, Kawasaki (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/867,761

(22) Filed: May 31, 2001

(65) Prior Publication Data

US 2002/0015312 A1 Feb. 7, 2002

(30) Foreign Application Priority Data

Jun. 2, 2000 (JP) ..... 2000-166000

(51) Int. Cl.[7] ..... F21V 7/00

(52) U.S. Cl. ..... 362/517; 362/518; 362/346; 362/297

(58) Field of Search ..... 362/507, 517, 362/518, 475, 476, 346, 297

(56) References Cited

U.S. PATENT DOCUMENTS

| | | | | |
|---|---|---|---|---|
| 6,062,714 | A * | 5/2000 | Serizawa et al. | 362/297 |
| 6,270,241 | B1 * | 8/2001 | Collot et al. | 362/507 |
| 6,334,702 | B1 * | 1/2002 | Albou | 362/465 |
| 6,419,380 | B2 * | 7/2002 | Oyama et al. | 362/297 |
| 6,431,737 | B1 * | 8/2002 | Oyama et al. | 362/247 |
| 2001/0026457 | A1 * | 10/2001 | Oyama et al. | 362/517 |
| 2001/0046138 | A1 * | 11/2001 | Oyama et al. | 362/517 |

FOREIGN PATENT DOCUMENTS

| | | | |
|---|---|---|---|
| JP | 2000-76907 | 3/2000 | |
| JP | 2000-182411 | 6/2000 | |
| JP | 2001-283618 | * 12/2001 | F21S/8/12 |

* cited by examiner

*Primary Examiner*—Thomas M. Sember
*Assistant Examiner*—John Amarantides
(74) *Attorney, Agent, or Firm*—Morgan, Lewis & Bockius LLP

(57) ABSTRACT

A vehicle light can include a multi-reflex optical system having a light source, a first reflecting surface system and a second reflecting surface system. The first reflecting surface system can include a parabolic group reflecting surface, an ellipse group reflecting surface or combination thereof. The second reflecting surface system can include an ellipse group reflecting surface having a first focus located approximately on the light source and a second focus. The ellipse group reflecting surface can be located such that it covers the front of the light source and collects light rays emitted from the light source directed to its second focus. The second reflecting surface system can include a parabolic group reflecting surface having a focus in the vicinity of the second focus of the ellipse group reflecting surface, and an adjusting reflecting plate located in the vicinity of the second focus of the ellipse group reflecting surface. The second focus of the ellipse group reflecting surface of the second reflecting surface system can be located away from and either above or below the first reflecting surface system. The overall shape of the vehicle light 1 can be substantially T-shaped or L-shaped.

17 Claims, 4 Drawing Sheets

VEHICLE LAMP

This invention claims the benefit of Japanese Patent Application No. 2000-166000, filed on Jun. 2, 2000, which is hereby incorporated by reference.

BACKGROUND OF THE INVENTION

1. Field of the Invention

The present invention relates to a vehicle lamp for use in the illumination of a headlamp, fog lamp, etc., and more particularly relates to a vehicle lamp design which allows for flexibility in the design of the overall shape of the vehicle lamp such that it can comply with vehicle body design requirements while providing high utilization efficiency of light emitted from the light source.

2. Description of the Related Art

FIGS. 7–9 show conventional vehicle lights 90 and 80. FIG. 7 illustrates a first conventional vehicle light 90 which includes a light source 91, a parabolic group reflecting surface 92 having a rotated parabolic surface with light source 91 as its focus, and a lens 93. Light emitted from the light source 91 is reflected by the parabolic group reflecting surface 92 such that it is parallel to an optical axis of the vehicle light 90. The light travels through a lens 93 having prismatic cuts 93*a* on its inner surface. The prismatic cuts 93*a* determine the light distribution pattern of the vehicle light 90. Although not illustrated, the parabolic group reflecting surface 92 can be a complex surface including parabolic cylinder elements. In such a case, the lens cuts 93*a* are not always necessary, and light distribution patterns of the vehicle light 90 can be determined solely by the parabolic group reflecting surface 92.

FIG. 8 illustrates a second conventional vehicle light 80 which includes a light source 81, an ellipse group reflecting surface 82 such as a rotated elliptic surface having the light source 81 as its first focus, a shading plate 83 located in the vicinity of the second focus of the ellipse group reflecting surface 82, and an aspherical projection lens 84. Light rays emitted from the light source 81 are reflected by the ellipse group reflecting surface 82 and converge at the second focus. The shading plate 83 blocks unnecessary light rays to form a light distribution pattern such that luminous flux at the second focus can have a cross sectional image which is appropriate for being projected by the aspherical projection lens 84. The aspherical projection lens 84 projects the cross-sectional image of luminous flux at the second focus towards an illumination direction of the vehicle light 80. The second conventional vehicle light 80 can be referred to as a projection-type vehicle light based upon its optical principles.

FIG. 9 illustrates a third conventional vehicle light 80, which is a projection-type vehicle light. The third conventional vehicle light 80 includes a light source 81, a plurality of, e.g., two, ellipse group reflecting surfaces 85 and 86 whose longitudinal axes are inclined to the outside relative to an optical axis of the third conventional vehicle light 80, and a plurality of, e.g., two, aspherical projection lenses 87 and 88, each corresponding to the ellipse group reflecting surfaces 85 and 86, respectively.

Conventional vehicle lights 90 and 80 have at least the following problems. The overall shape of the conventional vehicle lights 90 and 80 is limited to being substantially circular, substantially elliptic, or substantially rectangular. Therefore, if it is required for the vehicle light 90 and 80 to have unique overall shapes, such as substantially L-shaped or T-shaped, from a viewpoint of automobile body design, it is impossible to achieve sufficient light amount and sufficient light distribution characteristics. Accordingly, the conventional vehicle lights 90 and 80 are not able to meet with market demands for design flexibility.

SUMMARY OF THE INVENTION

In order to resolve the aforementioned problems in the related art, in the present invention, there is provided a vehicle light that can include a light source, a first reflecting surface system and a second reflecting surface system. The first reflecting surface system can include an ellipse group reflecting surface, a parabolic group reflecting surface, or combination thereof. The second reflecting surface system can include an ellipse group reflecting surface having a first focus on the light source and a second focus located away from and either above or below the first reflecting surface system for collecting light rays emitted from the light source that are directed to the second focus. The vehicle light can also include a parabolic group reflecting surface having its focus in the vicinity of the second focus of the elliptic group reflecting surface of the second reflecting surface system for directing light rays towards an illumination direction of the vehicle light, and can include an adjusting reflecting plate located in the vicinity of the second focus of the ellipse group reflecting surface of the second reflecting surface system for adjusting the directions of light rays traveling from the ellipse group reflecting surface to the parabolic group reflecting surface of the second reflecting surface system.

DETAILED DESCRIPTION OF THE PREFERRED EMBODIMENTS

Figure 1:
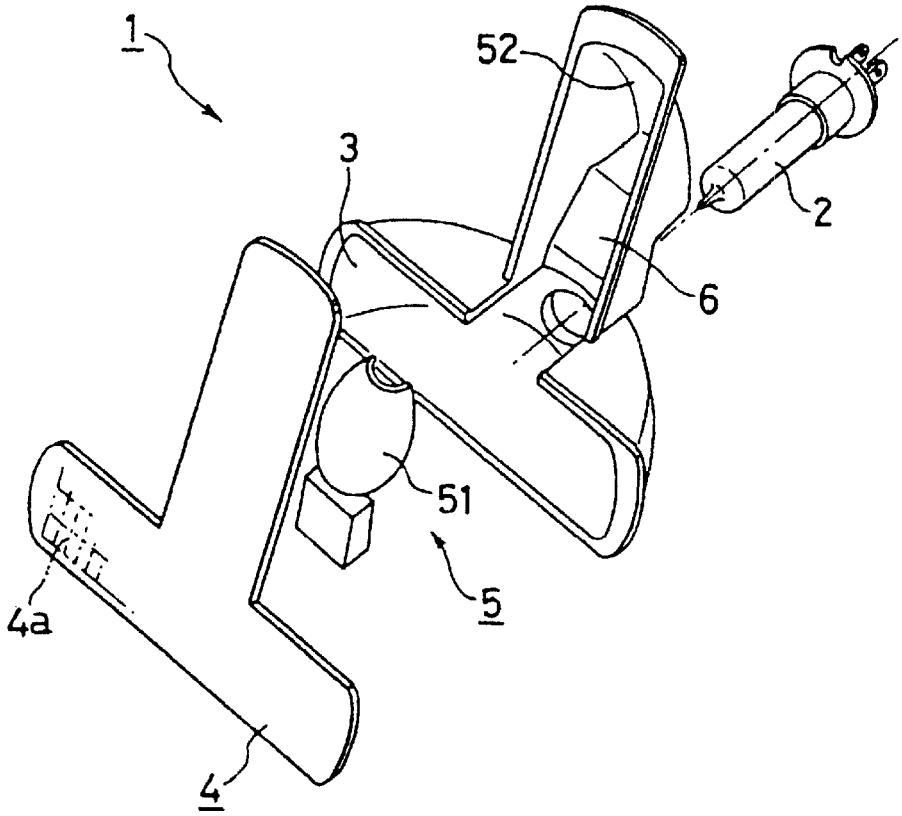
FIG. 1 is an exploded perspective view of a vehicle light according to a preferred embodiment of the invention.

Detailed description of the present invention will now be given based on embodiments shown in the drawings. Whenever possible, the same reference numbers are used throughout the drawings to refer to the same or like parts.

Figure 2:
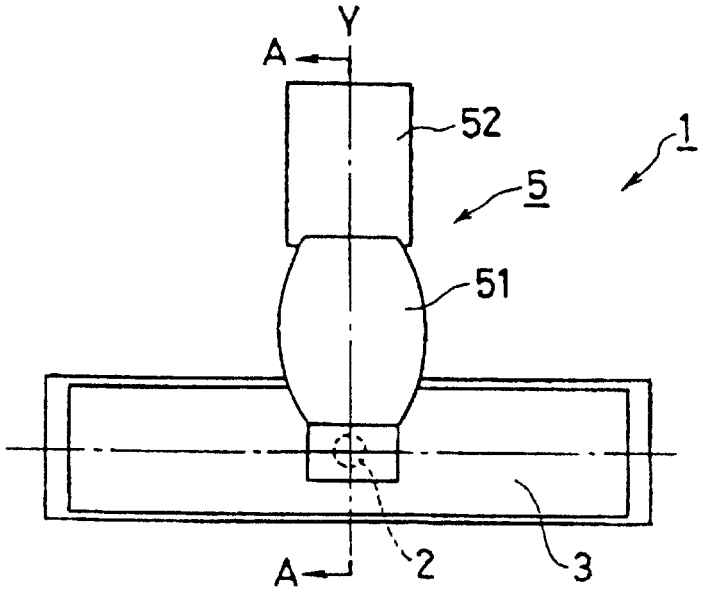
FIG. 2 is a partial front view of the preferred embodiment of FIG. 1.
Figure 3:
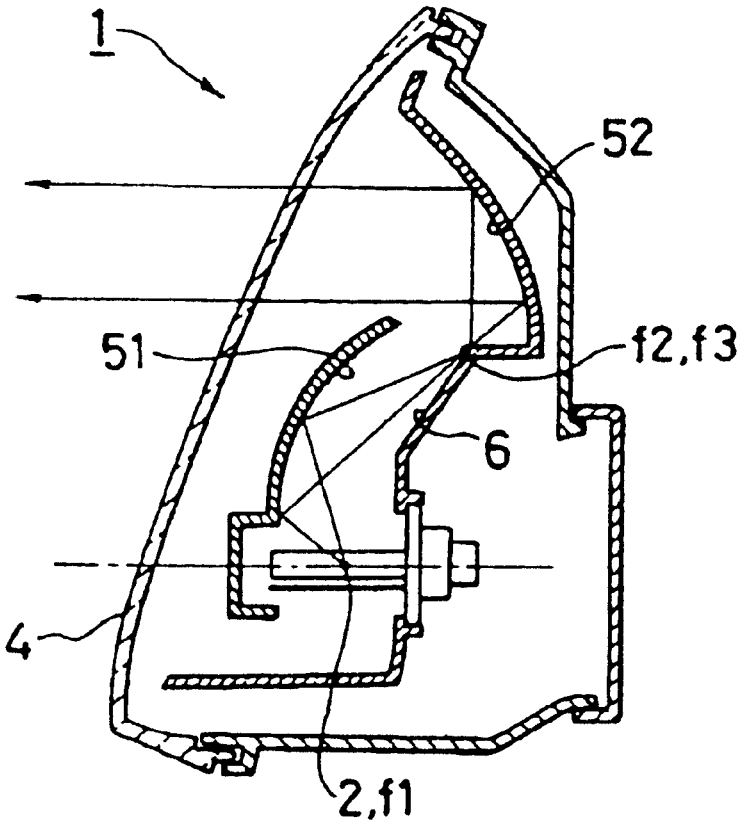
FIG. 3 is a cross-sectional view taken along line A—A of FIG. 2.

FIGS. 1–3 show a vehicle light 1 having a multi-reflex system according to a preferred embodiment of the present invention. The vehicle light 1 can include a light source 2 such as a halogen bulb, a first reflecting surface system 3 and a lens 4 having prismatic cuts 4*a* on its inner surface. The first reflecting surface system 3 can include a parabolic group reflecting surface such as a rotated parabolic surface having a focus on the light source 2. Light rays reflected by the first reflecting surface system 3 can be reflected to be parallel to an optical axis of the vehicle light 1, and diffused by prismatic cuts 4*a* on an inner surface of the lens 4, thereby providing illumination from the vehicle light 1 in predetermined directions.

The first reflecting surface system 3 can be a complex reflecting surface that includes parabolic cylinder elements such that light distribution characteristics of the vehicle light 1 are formed by only the first reflecting surface system 3 without necessity of the prismatic cuts 4*a* on the lens 4. Furthermore, the first reflecting surface system 3 can include a plurality of ellipse group reflecting surfaces, e.g., two ellipse group reflecting surfaces, whose longitudinal axes are inclined to the outside relative to an optical axis of the vehicle light 1. The lens 4 can include a plurality of aspherical lenses, each corresponding to each of the plurality of ellipse group reflecting surfaces.

A second reflecting surface system 5 can be provided in the vehicle light 1 and can include an ellipse group reflecting surface 51 such as a rotated elliptic surface for collecting light rays from the light source 2. The light source 2 can extend from a first focus of the reflecting surface 51 to its second focus. The second reflecting surface system 5 can also include a parabolic group reflecting surface 52 such as a rotated parabolic surface for directing light rays towards an illumination direction. The ellipse group reflecting surface 51 can cover the light source 2 as viewed from the front, and have a first focus on the light source 2. The ellipse group reflecting surface 51 can also have a second focus located away from, and either above or below the first reflecting surface system 3.

General characteristics of the ellipse group reflecting surface and the parabolic group reflecting surface are described as follows. The ellipse group reflecting surface can include a curved surface having an ellipse or its similar shape as a whole, such as a rotated elliptic surface, a complex elliptic surface, an ellipsoidal surface, an elliptical free-curved surface, or combination thereof. If a light source is located on a first focus of the ellipse group reflecting surface, light rays emitted from the light source can converge at a second focus of the ellipse group reflecting surface. The parabolic group reflecting surface can be defined as a curved surface having a parabola or similar shape as a whole, such as a rotated parabolic surface, a complex parabolic surface, paraboloidal surface, a parabolic free-curved surface, or combination thereof. Light rays emitted from a light source located on a focus of the parabolic group reflecting surface can be reflected to be parallel to the axis of the parabolic group reflecting surface.

The parabolic group reflecting surface 52 can have its focus f3 in the vicinity of the second focus f2 of the ellipse group reflecting surface 51, and can reflect light rays to substantially the same direction as the first reflecting surface system 3, i.e., an illumination direction of the vehicle light 1. The second reflecting surface system 5 can also function as a shade located in front of the light source 2 for preventing direct light from the light source 2 from directly illuminating the outside of the vehicle light 1.

The vehicle light 1 can further include an adjusting reflecting plate 6 located in the vicinity of the second focus f2 of the ellipse group reflecting surface 51 of the second reflecting surface system 5. The adjusting reflecting plate 6 can reflect light rays traveling from the ellipse group reflecting surface 51 to the parabolic group reflecting surface 52, and can adjust the direction of the light rays to be in a predetermined direction, e.g., in an upward direction, such that light rays which traveled to and are reflected by the parabolic group reflecting surface 52 are not further blocked by the ellipse group reflecting surface 51 or the first reflecting surface system 3. The location of the adjusting reflecting plate 6 can be determined to enable such adjustment. Accordingly, the adjusting reflecting plate 6 improves utilization efficiency of light emitted from the light source 2.

Figure 4:
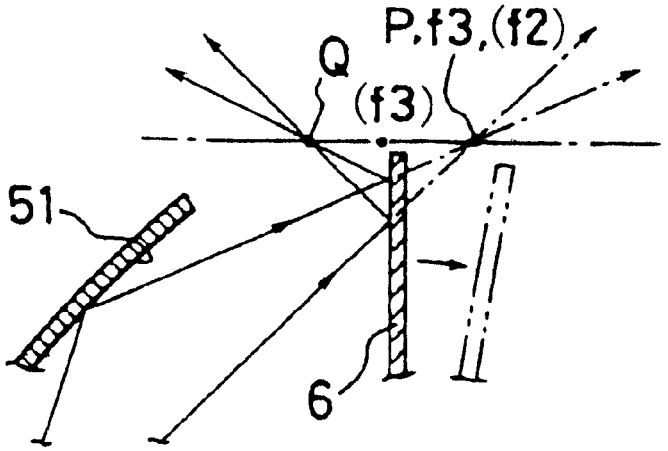
FIG. 4 is a diagram illustrating an operation of the adjusting reflecting plate according to the embodiment of FIG. 1.

Additionally, it is possible to change the light distribution pattern of the vehicle light 1 between traveling mode and passing-by mode, i.e., high-beam and low-beam, by movement of the adjusting reflecting plate 6. FIG. 4 illustrates a positional relationship of the focus f3 of the parabolic group reflecting surface 52, the second focus f2 of the ellipse group reflecting surface 51, the adjusting reflecting plate 6 and a focused image of light rays which are traveling from the ellipse group reflecting surface 51 and reflected by the adjusting reflecting plate 6. As shown by solid lines in FIG. 4, the adjusting reflecting plate 6 can be inserted in luminous flux at a predetermined angle in the vicinity of the second focus f2 of the ellipse group reflecting surface 51, and more specifically at a location just before the light rays reach the second focus f2. When the adjusting reflecting plate 6 is located at such a position, the image of light rays reflected by the adjusting reflecting plate 6 can be focused at the adjusted position Q, which is in front of the original position P. The original position P can be located at substantially the same position as the focus f3 of the parabolic group reflecting surface 52 when the adjusting reflecting plate 6 is not inserted in the luminous flux traveling from the ellipse group reflecting surface 51 to the second focus f2 of the ellipse group reflecting surface 51, i.e., a position indicated by dotted lines in FIG. 4. One end of the adjusting reflecting plate 6 can be fixed to allow pivotal movement of the adjusting reflecting plate 6. Accordingly, the adjusting reflecting plate 6 is able to take positions both in the middle of and away from the luminous flux that converges at the second focus f2 of the ellipse group reflecting surface 51.

The focus f3 of the parabolic group reflecting surface 52 can be located on the original position P or at a position between the original position P and the adjusted position Q. When the adjusting reflecting plate 6 is located in the middle of luminous flux traveling from the ellipse group reflecting surface 51, the light rays can converge to the adjusted position Q after being reflected by the adjusting reflecting plate 6. At this time, the adjusted position Q can be the substantial second focus of the ellipse group reflecting surface 51. In a case where the focus f3 of the parabolic group reflecting surface 52 is located between the original position P and the adjusted position Q (positions of foci f2 and f3 are indicated by f2 and f3 within respective parentheses), since the adjusted position Q is located in front of the focus f3 of the parabolic group reflecting surface 52 (which can be configured as a portion of a parabolic group reflecting surface such as a rotated parabolic surface), the light reflected by the parabolic group reflecting surface 52 does not include light rays traveling upward from the parabolic group reflecting surface 52. Accordingly, when the adjusted position Q is the substantial second focus f2, light reflected by the parabolic group reflecting surface 52 is appropriate for a low-beam light distribution pattern. In FIG. 4, the adjusting reflecting plate 6 can be inserted in the luminous flux traveling from the ellipse group reflecting surface 51 with an intersecting angle close to a right angle in order to clearly show the operation of the adjusting reflecting plate 6. However, in practical use of the vehicle light 1, it is preferable to set the intersecting angle of the adjusting reflecting plate 6 with the light rays traveling from the ellipse group reflecting surface 51 to be nearly parallel to the traveling direction of the light rays to prevent the direction of the traveling light rays from being greatly changed.

When the adjusting reflecting plate 6 is located away from luminous flux traveling from the ellipse group reflecting surface 51 (as shown by dotted lines in FIG. 4), the light rays can converge to the original position P. At this time, the original position P is the substantial second focus of the ellipse group reflecting surface 51. Since the original position P is located rearward of focus f3 of the parabolic group reflecting surface 52, light rays reflected by the parabolic group reflecting surface 52 include light rays traveling upward and to the front from the parabolic group reflecting surface 52. Accordingly, when the original position P is the substantial second focus f2 of the ellipse group reflecting surface 51, light reflected by the parabolic group reflecting surface 52 is appropriate for high-beam light distribution pattern.

On the other hand, in a case where the second focus f2 of the ellipse group reflecting surface 51 and the focus f3 of the parabolic group reflecting surface 52 are located on the original position P, and when the adjusting reflecting plate 6 is located in the middle of luminous flux traveling from the ellipse group reflecting surface 51 to the second focus f2, the adjusting reflecting plate 6 blocks certain light rays to form low-beam mode light distribution pattern. When the adjusting reflecting plate 6 is located away from the luminous flux traveling from the ellipse group reflecting surface 51 to the second focus f2, substantially all light rays are illuminated from the vehicle light 1 without being blocked by the adjusting reflecting plate 6, thereby forming the high-beam mode light distribution pattern of the vehicle light 1.

Furthermore, when it is not required for the vehicle light 1 to change light distribution pattern, e.g., when different vehicle lights 1 are provided for each light distribution pattern, it is not required to arrange the movable adjusting reflecting plate 6.

Figure 5:
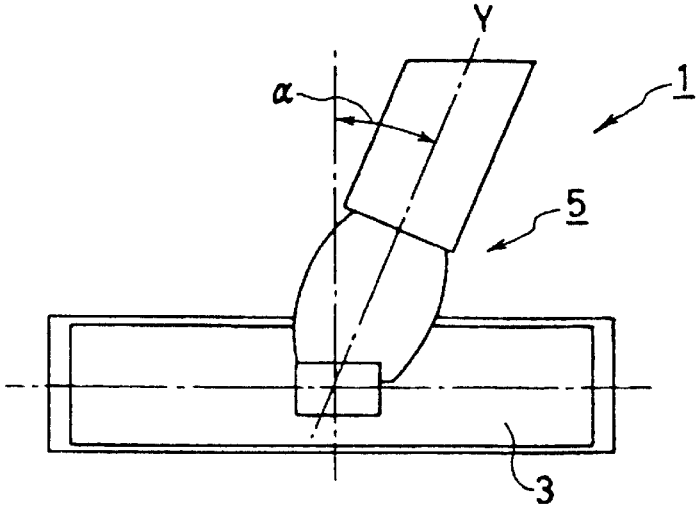
FIG. 5 is a front view of another preferred embodiment of the invention in which an axis of the second reflecting surface system is inclined relative to a vertical line passing through the light source.

The angle $\alpha$ between a vertical line passing through the light source 2 and a longitudinal axis Y of the ellipse group reflecting surface 51 can be flexibly determined depending on design requirements of the vehicle light 1. In FIG. 2, the longitudinal axis Y is substantially collinear with the vertical line passing through the light source 2. Alternately, as shown in FIG. 5, the longitudinal axis Y can be inclined relative to the vertical line passing through the light source 2.

Additionally, the second focus f2 of the ellipse group reflecting surface 51 can be located either above or below the first reflecting surface system 3. Whether above or below the first reflecting surface system 3, the location of the second focus f2 can be chosen depending on design requirements of the vehicle light 1. When the second focus f2 of the ellipse group reflecting surface 51 is located above the first reflecting surface system 3, an overall shape of the vehicle light 1 can be a reversed substantial "T" as viewed from the front, as shown in FIG. 2. When the second focus f2 of the ellipse group reflecting surface 51 is located below the first reflecting surface system 3, an overall shape of the vehicle light 1 can be a substantial "T" as viewed from the front.

In the vehicle light 1, light distribution characteristics of light illuminated from the first reflecting surface system 3 can be determined by the first reflecting surface system 3 and/or prismatic cuts 4*a* on an inner surface of the lens 4.

Additionally, light rays emitted from the light source 2 directed upward and to the front (or downward and to the front) can be captured by the ellipse group reflecting surface 51 and caused to converge to the second focus f2. The parabolic group reflecting surface 52 reflects light rays from the second focus f2 of the ellipse group reflecting surface 51 to an illumination direction of the vehicle light 1, i.e., parallel to the optical axis of the vehicle light 1. When the vehicle light 1 is illuminated, the parabolic group reflecting surface 52 "shines," and an overall shape of the vehicle light 1 is perceived as a reversed substantial "T" (or a substantial "T").

Light rays reflected by the ellipse group reflecting surface 51 are preferably those emitted from the light source 2 upward and to the front and not those reflected by the first reflecting surface system 3. Accordingly, the amount of light that is illuminated towards the outside of the vehicle light 1 can be increased by the amount of light reflected by the ellipse group reflecting surface 51.

Figure 6:
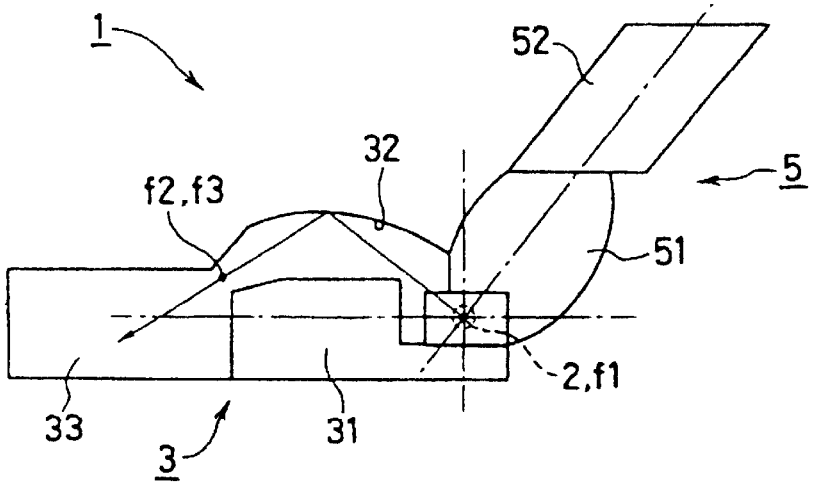
FIG. 6 is a partially broken front view of a still further preferred embodiment of the present invention in which a portion of the first reflecting surface system adjacent to the light source is removed to show light passage from the light source.
Figure 7:
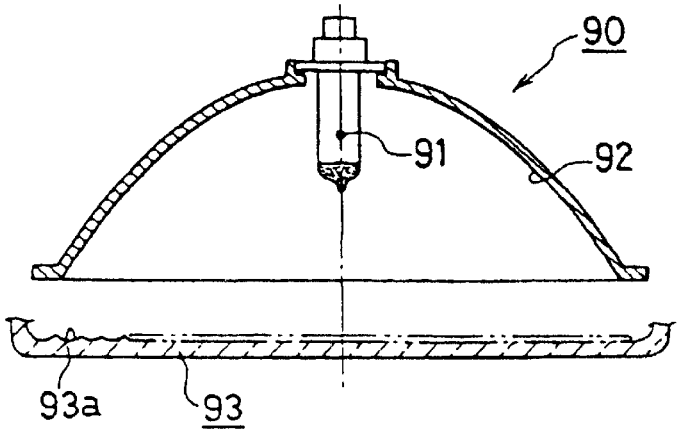
Fig.7 CONVENTIONAL ART
FIG. 7 is a cross-sectional view of a first conventional vehicle light.
Figure 8:
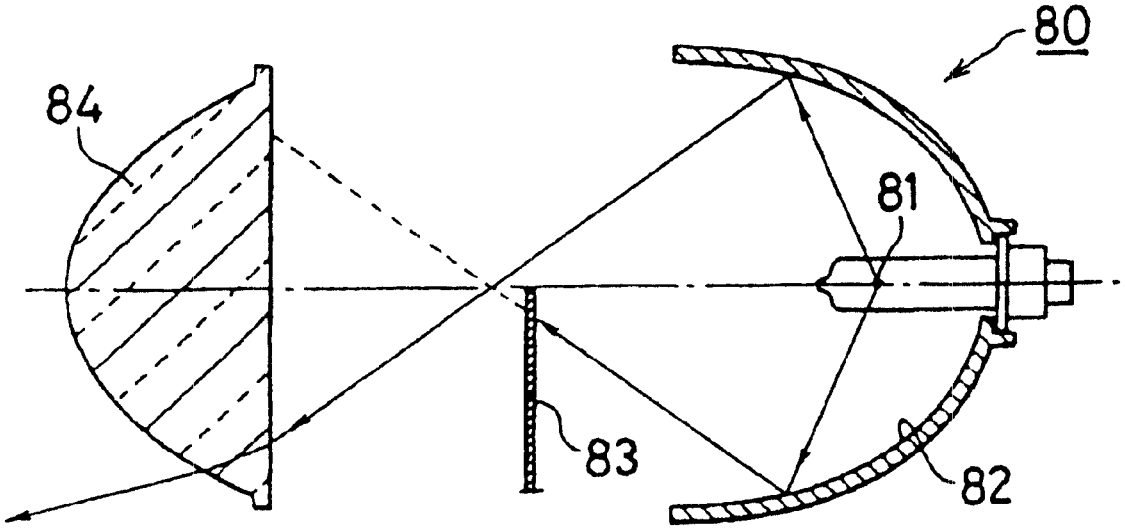
Fig.8 CONVENTIONAL ART
FIG. 8 is a cross-sectional view of a second conventional vehicle light.
Figure 9:
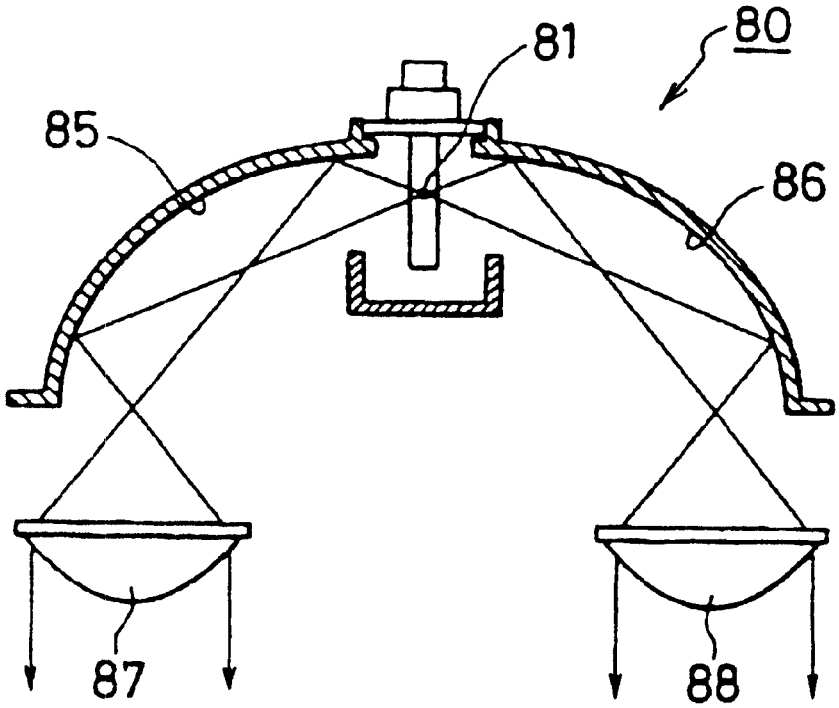
Fig.9 CONVENTIONAL ART
FIG. 9 is a cross-sectional view of a third conventional vehicle light.

FIG. 6 illustrates a vehicle light 1 according to another preferred embodiment of the present invention. In this embodiment, a first reflecting surface system 3 can include a plurality of reflecting surfaces, i.e., a first parabolic group reflecting surface 31 such as a rotated parabolic surface having a focus on the light source 2 for reflecting light rays to an illumination direction of the vehicle light 1, an ellipse group reflecting surface 32 having a first focus f1 on the light source 2 for reflecting light rays emitted from the light source 2 to its second focus f2, a second parabolic group reflecting surface 33 having its focus on the second focus f2 of the ellipse group reflecting surface 32 and which can reflect light rays towards an illumination direction of the vehicle light 1. The first parabolic group reflecting surface 31 and the second parabolic group reflecting surface 33 can be located on the left side of the vehicle light 1 as viewed from the front.

The ellipse group reflecting surface 32 can be located on the upper side of the first parabolic group reflecting surface 31. The ellipse group reflecting surface 32 can also be located on the lower side of the first parabolic group reflecting surface 31. The shapes and locations of the ellipse group reflecting surface 32 and the first parabolic group reflecting surface 31 can be determined without referring to the optical functions of each other, preferably not within the optical path of each other. The optical functions of the ellipse group reflecting surface 32 and the second parabolic group reflecting surface 33 can be substantially the same as those of the ellipse group reflecting surface 51 and the parabolic group reflecting surface 52 of the second reflecting surface system 5.

Accordingly, based on the same principles of the ellipse group reflecting surface 51 and the parabolic group reflecting surface 52, an adjusting reflecting plate 6 can be provided with the ellipse group reflecting surface 32 and the second parabolic group reflecting surface 33 of the first reflecting surface system 3. Light distribution patterns of the vehicle light 1 can be switched between high-beam mode and low-beam mode by movement of the adjusting reflecting plate 6 for the first reflecting surface system 3. By the configuration described above, and as shown in FIG. 6, the vehicle light 1 can be substantially L-shaped in front view, which provides a new and unique appearance for the vehicle light 1.

Some of the operational advantages of the present invention will now be described. The present invention provides a vehicle light 1 that can include a first reflecting surface system 3 and a second reflecting surface system 5. The first reflecting surface system 3 can include a parabolic group reflecting surface, an ellipse group reflecting surface, or combination thereof. The second reflecting surface system 5 can include an ellipse group reflecting surface 51 located such that it covers the front of a light source 2. The ellipse group reflecting surface 51 can include a first focus f1 on the light source 2 and a second focus f2 located away from, and either above or below, the first reflecting surface system 3. The second reflecting surface system 5 can also include, a parabolic group reflecting surface 52 having a focus f3 in the vicinity of the second focus f2 of the ellipse group reflecting surface 51 and an adjusting reflecting plate 6 located in the vicinity of the second focus f2 of the ellipse group reflecting surface 51. In the second reflecting surface system 5, the location of the first focus f1 of the ellipse group reflecting surface 51 can be fixed on the light source 2. On the other hand, location of the second focus f2 of the ellipse group reflecting surface 51 can be flexibly determined at any point of an arc formed by a pivotal rotational movement of the ellipse group reflecting surface 51 about a fixed end on the first focus f1. Therefore, by combination of the second reflecting surface system 5 with the first reflecting surface system 3, the vehicle light 1 provides a novel overall appearance, including substantial "T" or "L" shapes. Since the overall shape and location of the vehicle light 1 can be designed with great flexibility, the flexibility of automobile body design is also greatly improved.

It will be apparent to those skilled in the art that various changes and modifications can be made herein without departing from the spirit and scope of the invention. Thus, it is intended that the present invention cover the modifications and variations of the invention provided they come within the scope of the appended claims and their equivalents.

What is claimed is:

1. A vehicle light having a multi-reflex optical system, comprising:

a light source;

a first reflecting surface system including a reflecting surface;

a second reflecting surface system including;

an ellipse group reflecting surface having a first focus located approximately at the light source and a second focus, the ellipse group reflecting surface configured to collect light rays emitted from the light source directed to the second focus;

a parabolic group reflecting surface having a focus located approximately at the second focus of the ellipse group reflecting surface; and an adjusting reflecting plate located approximately at the second focus of the ellipse group reflecting surface.

2. The vehicle light according to claim 1, wherein the reflecting surface of the first reflecting surface system is one of an ellipse group reflecting surface, a parabolic group reflecting surface, and a combination of an ellipse group reflecting surface and a parabolic group reflecting surface.

3. The vehicle light according to claim 1, wherein the second focus of the ellipse group reflecting surface of the second reflecting surface system is located at one of a position above the first reflecting surface system and a position below the first reflecting surface system.

4. The vehicle light according to claim 1, wherein the adjusting reflecting plate of the second reflecting surface system is movable, and a light distribution of the vehicle light can be changed by movement of the reflecting plate.

5. The vehicle lamp according to claim 2, wherein the reflecting surface of the first reflecting surface system includes an ellipse group reflecting surface and a parabolic group reflecting surface, and the adjusting reflecting plate includes an adjusting reflecting surface located approximately at one of a second focus of the ellipse group reflecting surface of the first reflecting surface system and the second focus of the ellipse group reflecting surface of the second reflecting surface system.

6. The vehicle lamp according to claim 3, wherein the reflecting surface of the first reflecting surface system includes an ellipse group reflecting surface and a parabolic group reflecting surface, and the adjusting reflecting plate includes an adjusting reflecting surface located approximately at one of a second focus of the ellipse group reflecting surface of the first reflecting surface system and the second focus of the ellipse group reflecting surface of the second reflecting surface system.

7. The vehicle lamp according to claim 1, wherein the second focus is located at a distance from the first reflecting surface system.

8. The vehicle lamp according to claim 1, wherein the ellipse group reflecting surface covers the light source.

9. The vehicle lamp according to claim 1, wherein the ellipse group reflecting surface is located in front of the light source.

10. The vehicle lamp according to claim 1, wherein the second focus of the ellipse group reflecting surface is located outside of the optical path of the first reflecting surface system.

11. A vehicle light having a multi-reflex optical system, comprising:

a light source;

a first reflecting surface system having a primary longitudinal axis;

a second reflecting surface system having a secondary longitudinal axis that is oriented at an angle greater than zero with respect to the primary longitudinal axis of the first reflecting surface system, the second reflecting surface system including, an ellipse group reflecting surface having a first focus located approximately at the light source and a second focus, and a parabolic group reflecting surface having a focus located approximately at the second focus of the ellipse group reflecting surface.

12. The vehicle light according to claim 11, further comprising:

an adjusting reflecting plate located approximately at the second focus of the ellipse group reflecting surface.

13. The vehicle light according to claim 11, wherein the first reflecting surface system includes one of an ellipse group reflecting surface, a parabolic group reflecting surface, and a combination of an ellipse group reflecting surface and a parabolic group reflecting surface.

14. The vehicle light according to claim 11, wherein the second focus of the ellipse group reflecting surface of the second reflecting surface system is located at one of a position above the first reflecting surface system and a position below the first reflecting surface system.

15. The vehicle light according to claim 12, wherein the adjusting reflecting plate is movable, and a light distribution of the vehicle light can be changed by movement of the reflecting plate.

16. The vehicle lamp according to claim 12, wherein the first reflecting surface system includes an ellipse group reflecting surface and a parabolic group reflecting surface, and the adjusting reflecting plate includes an adjusting reflecting surface located approximately at one of a second focus of the ellipse group reflecting surface of the first reflecting surface system and the second focus of the ellipse group reflecting surface of the second reflecting surface system.

17. The vehicle lamp according to claim 13, wherein the first reflecting surface system includes an ellipse group reflecting surface and a parabolic group reflecting surface, and an adjusting reflecting surface is located approximately at one of a second focus of the ellipse group reflecting surface of the first reflecting surface system and the second focus of the ellipse group reflecting surface of the second reflecting surface system.

* * * * *